United States Patent [19]

Grard et al.

[11] 4,245,689

[45] Jan. 20, 1981

[54] DIMENSIONALLY STABLE CELLULOSIC BACKING WEB

[75] Inventors: Henry P. Grard, Verviers-Heusy, Belgium; Daniel LaVietes, Lexington, Va.; Edmond M. Mergelsberg, Liege, Belgium

[73] Assignee: Georgia Bonded Fibers, Inc., Buena Vista, Va.

[21] Appl. No.: 902,088

[22] Filed: May 2, 1978

[51] Int. Cl.[3] ..... D21H 5/02; D21H 5/18; B05D 5/00; B32B 5/02

[52] U.S. Cl. ..... 162/134; 162/135; 162/137; 162/145; 162/146; 162/158; 162/161; 162/162; 162/168 R; 162/169; 162/172; 162/181 R; 162/181 B; 162/181 C; 162/183; 162/184; 427/385; 427/391; 428/236; 428/286; 428/288; 428/290; 428/297; 428/310; 428/313; 428/314

[58] Field of Search ..... 162/145, 156, 146, 135, 162/181 R, 181 A, 181 B, 168 R, 137, 169, 172, 161, 166, 165, 183, 158, 168 N, 162, 181 C, 184, 134; 427/391, 385; 428/310, 313, 314, 236, 237, 286, 288, 290, 297; 156/78, 306, 309

[56] References Cited

U.S. PATENT DOCUMENTS

| | | | |
|---|---|---|---|
| 3,036,950 | 5/1962 | Martin | 162/145 |
| 3,135,590 | 6/1964 | Campbell et al. | 162/145 |
| 3,223,580 | 12/1965 | Eckert et al. | 162/145 |
| 3,501,370 | 3/1970 | Juredine | 428/315 |
| 3,749,638 | 7/1973 | Renaud | 162/145 |
| 3,764,454 | 10/1973 | Healy et al. | 428/297 |
| 3,766,003 | 10/1973 | Schuller et al. | 162/156 |
| 4,011,130 | 3/1977 | Worden | 162/181 R |

FOREIGN PATENT DOCUMENTS

| | | | |
|---|---|---|---|
| 565592 | 11/1958 | Canada | 162/145 |
| 1059289 | 2/1967 | United Kingdom . | |
| 1166288 | 10/1969 | United Kingdom . | |
| 1338759 | 11/1973 | United Kingdom | 162/169 |
| 1422860 | 1/1976 | United Kingdom . | |
| 1470098 | 4/1977 | United Kingdom . | |
| 1522280 | 8/1978 | United Kingdom . | |
| 1544330 | 4/1979 | United Kingdom . | |

OTHER PUBLICATIONS

Battista, "Synthetic Fibers in Papermaking" (1964), pp. 103–117.

Gelbert, "Neoprene treated Paper" (1962), pp. 4–26.

"Latex Man. HL–2", B. F. Goodrich, pp. 1–40.

Charon et al., "Glass Fib. for Papermaking Spur" Pulp and Paper, Oct. 1971, pp. 84–88.

*Primary Examiner*—Peter Chin

*Attorney, Agent, or Firm*—Clarence A. O'Brien; Harvey B. Jacobson

[57] ABSTRACT

An improved dimensionally stable backing web is disclosed, especially for resilient flooring product and linoleum, comprising cellulosic fiber, a binder, antioxidant, fungicide and glass fiber, as well as optionally dyes or pigments, surfactants and vulcanizing agents. Also optionally present are calcium silicate mineral fiber or synthetic fiber, such as polyolefin, polyester, nylon, acrylic or modacrylic fiber, a cellulose acetate or mixtures thereof. The binder can be a natural rubber or synthetic rubber latex or mixtures thereof. The synthetic rubber latex is preferably selected from the following: styrene-butadiene; carboxylated styrene-butadiene, polyacrylic ester, polyvinyl acetate; polyisobutylene, a copolymer formed from vinyl acetate monomers and acrylic acid; polychloroprene, acrylonitrile-butadiene or carboxylated acrylonitrile-butadiene; polyurethane; a copolymer of ethylene and vinyl acetate; or other elastomeric copolymers. The glass fiber is dispersed into a slurry which is introduced in manufacturing the backing web by wet web impregnation, dry web impregnation, latex beater deposition, or continuous latex wet-end deposition, preferably by wet web impregnation. The web can be used alone or in combination with one or more surface coatings to form a layered material.

27 Claims, 5 Drawing Figures

DIMENSIONALLY STABLE CELLULOSIC BACKING WEB

BACKGROUND OF THE INVENTION

1. Field of the Invention

The invention relates to a backing web for many uses, but particularly for resilient flooring materials which are applied and adhered to floors or other like surfaces. Many products of resilient flooring materials have a backing sheet web of a fibrous, felted, matted, nonwoven, or other construction comprising a major proportion of cellulosic fiber, such as wood pulp, rags, cotton linters, rayon, or the like. Such backing webs impart many useful properties to the resilient flooring material, such as an increase of strength, wear life, and servicability, as well as characteristics of the resilient flooring material. The backing web, depending upon the type and composition of backing web, can give the product various other desirable properties, such as high resiliency, good feel, and high resistance to abrasion, as well as adherence to a wall or floor surface by use of a suitable mastic.

When resilient flooring materials are installed on floor surfaces of considerable width or length, particularly as is commonly encountered in mobile homes, offices, public buildings, schools, nautical construction, and the like, a problem has been observed immediately after installation of a resilient flooring material with a back web, particularly when installed in relatively great lengths, such as 100 feet or more. Manifesting itself in a tendency of the resilient flooring material to grow in length, or shrink, the problem appears in the form of swelling, buckling, formation of upraised regions, ridges or other undesirable manifestations which can detract considerably from the appearance of the floor covering. Furthermore, this undesirable tendency to growth appears to depend upon the level of relative humidity at the time of installation of the resilient flooring material, being greater at relatively low percentages of relative humidity, a condition under which many installations of floor coverings frequently are carried out.

In response to problems associated with an undesirable growth tendency in resilient flooring material having a backing web, certain approaches have been made. For instance, asbestos has been used to overcome such growth tendency and to impart dimensional stability to the resilient flooring material product when a major proportion of asbestos fibers are incorporated within the material making up the backing web of a resilient flooring material. However, human health hazards associated with industrial use of asbestos have come to light in recent years as defined in permissible exposure standards published in the U.S. Federal Register, Vol. 39, No. 125, Part II, pp. 23543–45, June 27, 1974, under provisions of the Occupational Safety and Health Act. These health hazards, including the possibility of serious diseases of the human lungs have led to a widespread search for suitable substitutes for asbestos in all industrial and consumer products containing greater than insignificant amounts of asbestos.

Further problems are encountered from curling of a resilient flooring material having a backing web when the product is removed from a region of lower humidity to an environment of higher humidity. The unbacked layers of flooring material exhibit little or no lateral extension under such conditions, but an associated cellulosic backing web tends to extend laterally when the surrounding environment changes in relative humidity to more humid conditions. Such differential extension causes upward curling at the edge of a resilient flooring material applied with the backing web downward against a subflooring material.

Only by providing a backing web with substantial dimensional stability can the dual problems of growth and curling in a resilient flooring material be avoided.

When used alone the backing web can be manufactured into map paper, chart paper, graph paper, or other papers with desirable properties, such as flexibility, dimensional stability and absence of problems identified above as associated with use of asbestos.

When used alone the backing web can form other useful asbestos-free products with dimensional stability and desirable properties, such as gasketing, filters, acoustical board and packaging. Other products with certain of these advantages can be made from the backing web alone, inclluding visor board, shoe insoles and hat brim material.

2. Description of the Prior Art

Methods are known for reducing the growth of cellulose-backed flooring products, such as the method disclosed in U.S. Pat. No. 4,066,183 to Winters, et al. This patent discloses including a growth inhibitor in the cellulosic backing of the flooring product, the growth inhibitor being a soluble salt containing aluminum or other trivalent metal cation. The present invention teaches away from addition of a growth inhibitor such as that described in the Winters et al patent by focusing instead on the nature and composition of fiber used.

Also known are methods for papermaking, including wet end addition of neoprene latex added to a fiber slurry prior to sheet formation, where cellulose, asbestos, glass synthetic fibers, and the like, can comprise the slurry, as well as wet web and dry web impregnation of fibrous mats, as disclosed in technical product literature published by the Elastomer Chemicals Department, E. I. DuPont de Nemours, Inc., Wilmington, Delaware, entitled "Neoprene Treated Paper" by C. H. Gelbert.

The incorporation of rubber binder in fibrous webs containing cellulose fiber, asbestos fiber, and pigments by dry web impregnation and latex deposition methods has also been described in technical product literature published by the B. F. Goodrich Chemical Company, Cleveland, Ohio, entitled "Latex Manual HL-2".

Use of glass fibers in papermaking is known, where fine glass fiber is introduced into a dispersion which can be blended with wood pulp. See, for example, in the article by C. W. Charon & L. C. Renaud, Pulp and Paper, October 1971, pp. 84–88, the use of glass fibers in pulp to increase dimensional stability of paper, such as papers for application in blueprints, drafting papers, charts or maps. Such papers, however, have poor edge tearing resistance, poor resistance to folding and poor wetting resistance.

Other patents illustrating related concepts in the prior art are the following:

U.S. Pat. No. 2,165,788—July 11, 1939—Elmendorf
U.S. Pat. No. 3,293,094—Dec. 20, 1966—Nairn et al
U.S. Pat. No. 3,293,108—Dec. 20, 1966—Nairn et al

SUMMARY OF THE INVENTION

The present invention provides an asbestos-free backing web, particularly for resilient flooring materials and linoleum, comprising a major proportion of cellulosic fiber and a minor proportion of glass fiber. Desirable properties result, including maximum backing web dimensional change of about 0.5% when subjected to heat, relative humidity changes in the range of relative humidity of 0 to 100%, or water wetting. The resilient flooring material or linoleum manufactured with backing web of the present invention has considerable curl resistance under high humidity conditions. Other useful properties resulting from the backing web of the present invention containing suitable adjuvants include high resistance to fungi, resistance to stiffening and discoloration at high temperature during manufacturing of flooring material, resistance to indentation, and resistance of the finished flooring material to delamination by a moving weight. The invention can be practiced by one of four methods, namely, by wet web impregnation, by dry web impregnation, by latex beater deposition, or by continuous latex wet-end deposition. A technique for dispersion of glass fibers into an aqueous slurry is also disclosed.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
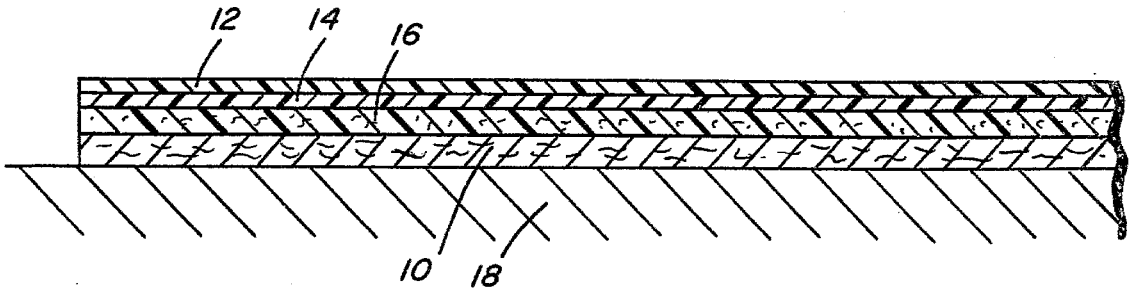
FIG. 1 is a fragmentary, sectional, elevational view of a portion of a typical resilient flooring material having a web backing of the present invention when applied to a wood or other substance or substrate.

The backing web 10 of the present invention can be used alone or in combination with any standard or conventional wear layer 12, decorative print layer 14 and foam layer 16 applied to underlying backing web 10 by any conventional coating or laminating method. The layered article is applied to surface 18 by conventional means, such as with an adhesive or suitable mastic. When the layered article is a floor covering material, as shown in FIG. 1 embodiment, surface 18 is a wooden floor, cement slab, or other conventional flooring. Foam layer 16 can, for example, be a thermoplastic polymer of polyvinyl chloride, or a copolymer, block polymer, or graft polymer of polyvinyl chloride and one or more other copolymerizable resins, such as vinyl acetate, vinyl propionate, vinyl butyrate, vinylidene chloride, and other vinyl formulations. Less preferred, but contemplated within the broader aspects of the present inventive concept are foam layers comprising a thermoplastic polymer of alkyl methacrylates, alkyl acrylates, polyurethanes, polyamides, polyesters, polyolefins, polystyrenes, polycarbonates, synthetic or natural rubber latex foam, and the like. Foam layer 16 can contain a blowing or foaming agent, such as described in U.S. Pat. No. 3,293,094 to Nairn et al, listed above, or can be mechanically foamed, as is described in U.S. Pat. No. 1,852,447 to Chapman. Decorative print layer 14 can be applied by any conventional printing means, such as a silk screen apparatus, a flat bed printing machine of the type commonly used in the smooth surface flooring industry, or a conventional rotogravure press with etched cylinders which apply a suitable ink to foam layer 16 to comprise decorative print layer 14. Although not illustrated in FIG. 1, an embossing procedure applicable to foamable compositions can be used to provide a textured or embossed surface, and embossed areas can be in register with a printed design. An embossing method is described in U.S. Pat. No. 3,293,094 to Nairn et al.

Fibrous cellulosic backing web 10 is prepared from fibers and other materials by first dispersing the fibers in fresh or recycled mill water. A major proportion of cellulosic fibers and a minor proportion of glass fibers, which can also be in association with other fibers, such as calcium silicate mineral fiber or synthetic fibers of various types, are blended to form an aqueous slurry which can also contain the other dyes, pigments, binders, and other adjuvants performing specific functions. The glass fibers are dispersed in water by blending with refined cellulosic pulp and other associated fibers and additives in a glass fiber dispersion tank. It is important to avoid introducing glass fibers into the pulper and refiner used for preparing the cellulosic pulp, to avoid breakage of glass fibers. The glass fiber slurry can now be blended with other materials and manufactured by one of the processes to be described, ultimately yielding a matted, felted, non-woven fibrous sheet consisting of a fibrous portion and additives, and a binder composition and additives present in the final backing web. The fibrous portion and additives are preferably present to comprise from about 50% by weight to about 88% by weight of dry weight of the final cellulosic web, with the binder composition and additives comprising from about 50% by weight to about 12% by weight of dry weight of final cellulosic backing web. Table I shows ranges of components comprising the fibrous portion and fibrous portion additives. Table II shows ranges of components of the binder portion and binder portion additives. In Table II and Table V, reference to a stearylated melamine resin is to a material which can be considered as a synthetic wax, a preferred example being the proprietary product of Sun Chemical Corporation, Chester, South Carolina, available under the trade name "Sunsize 133". Table III shows the composition of the backing web in terms of the total weight of components of Table I and the total weight of components of Table II.

The cellulosic fiber to which reference is made in Table I can be derived from a single source or from a plurality of sources, preferably wood pulp, rags, or cotton linters. Other cotton or vegetable fibers can also be used, such as flax, hemp, abaca, jute, straw, ramie, sisal, istle, china grass, cotton grass, agave, pita, esparto, eucalyptus, evergreen or coniferous wood fibers, deciduous or broad-leaf hardwood fibers, comminuted or macerated waste fibers, viscous fibers, regenerated cellulose or cuprammonium type fibers, rayon, or other fibers. The synthetic fiber to which reference is made in Table I can be a polyolefin, such as polyethylene, polypropylene, polybutylene, or the like, a polyester, a nylon, an acrylic or modacrylic, an acetate or mixtures thereof. The synthetic rubber lates to which reference is made in Table II, can be a resin selected from the following group: styrene-butadiene, carboxylated styrene-butadiene, polyacrylic ester, polymethacrylic ester, copolymers or acrylic ester and methacrylic ester, acrylonitrile-acrylic ester copolymer, polyvinyl acetate, polyisobutylene, a copolymer of vinyl acetate and acrylic ester, polychloroprene, acrylonitrilebutadiene, carboxylated acrylonitrile-butadiene, a polyurethane, a copolymer of ethylene and vinyl acetate or other elastomeric copolymers.

Examples I–III of Table IV give three specific examples of formulations of fibrous portions and additives, along with the total present in the backing web. Example IV of Table IV is the fibrous portion of a control sample, hereinafter described as Sample B. Examples V–VIII of Table V give four examples of formulations of the binder portion and additives, along with the total amount present in the backing web. Example IX of Table V is the binder portion of a control sample hereinafter described as Sample B. It is to be understood that, since each of the examples above represents a formulation for only a portion of the materials constituting a backing web, the remaining portion having an unspecified composition, none of the examples represents a complete formulation for the backing web, but the examples are merely intended to illustrate specific components and amounts present in each of these portions. Comparative samples were prepared from certain of the examples identified in Table IV and Table V, as are listed in Table VI and as will be hereinafter described.

Figure 2:
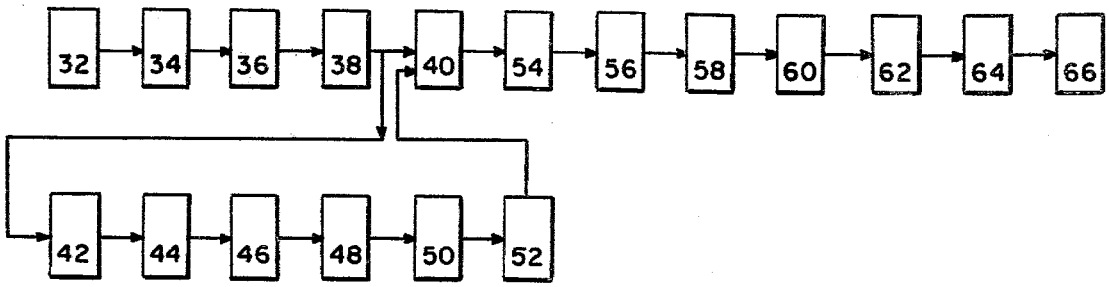
FIG. 2 is a block diagram illustrating steps in a method for making a backing web by wet web impregnation.

In the method of wet web impregnation, as illustrated in FIG. 2, all components except glass fibers of the fibrous portion and fibrous portion additives listed in Table I are added with agitation to fresh or recycled mill water contained in pulper 32, which can be a pulper sold under the trademark "Hydrapulper". Pulper 32 is a large vessel equipped with a rotor with blades near the bottom of the vessel for agitation of dry pulp, other fibrous materials and additives, except for glass fibers, in a large volume of water. Dispersion of the fibrous materials and additives in the water gives a fiber slurry, which is transferred to drop chest 34, a chest containing a stirrer for continued agitation of the fiber slurry charge from pulper 32. The slurry is pumped from drop chest 34 through refiner 36, which is a vessel within which fibers in the fiber slurry are cut and the surfaces of the fibers are roughened to improve their bondability. The refiner comprises a metal housing containing blades, and a second set of blades located upon a core which is rotated during passage of the fiber slurry through refiner 36. Machine chest 38 receives the fiber slurry from refiner 36 and machine chest 38 contains a stirrer and also receives edge trim cut from the web made on sheet former 54. The fiber slurry from machine chest 38 goes to fan pump 40, but a portion of the fiber slurry is transferred as required to glass fiber dispersion tank 42, where glass fiber as well is introduced for batchwise preparation of glass fiber dispersion. To prepare a batch of glass fiber dispersion in tank 42, tank 42 is filled to part of its capacity with water at ambient temperature, preferably to about half its capacity. A small portion of slurry from machine chest 38 is then added to glass fiber dispersion tank 42 with agitation. Water at ambient temperature is then added to the final volume, namely, to about the capacity of tank 42. Glass fiber is then introduced into tank 42, preferably in numerous small portions, such as 10 to 15 equal portions, and agitation is continued in tank 42 during such introduction of glass fiber. Glass fiber is introduced into tank 42 in the quantity to give a final dry weight of glass fiber equal to the final dry weight of solids within the slurry introduced from machine chest 38 into tank 42. Agitation is continued, after which the entire batch from tank 42 is transferred by pump 44 into dispersion holding tank 46. Dispersion holding tank 46 has a capacity about double the capacity of dispersion tank 42, and tank 46 is provided to continuously supply, by means of pump 48, dispersion feed tank 50, which is kept filled close to its capacity. As the supply of glass fiber dispersion in dispersion holding tank 46 becomes depleted, a new batch of glass fiber dispersion is prepared by the foregoing procedure in dispersion tank 42, after which holding tank 46 is refilled. In this manner, feed tank 50 maintains a uniform quantity of glass fiber dispersion, which is pumped by pump 52 into the inlet of fan pump 40. Slurry from machine chest 38 is necessary in preparation of the glass fiber dispersion in tank 42 in order to prepare a proper dispersion of glass fiber. It is necessary to introduce glass fiber dispersion at an intermediate step in the wet web impregnation process due to the fact that severe fiber breakage would be expected if glass fiber were introduced earlier so as to be present in pulper 32 or refiner 36.

Glass fiber dispersion from pump 52 enters fan pump 40, along with the slurry from machine chest 38 containing fibers other than glass and fibrous portion additives. In addition, recycled mill water is added for dilution to the proper consistency for slurry stock. Typically, slurry stock in fan pump 40 contains about 99% water, and is mixed in fan pump 40 before transfer to sheet former 54. Sheet former 54 is of conventional construction, and can be one of several types sold under various trademarks, such as Fourdrinier, Harper Fourdrinier, Deltaformer, Cylinder, Rotoformer, Papriformer, Inverform, Twinverform, Vertiforma, Bel Baie Former, and others. On the sheet former, a web is formed by removal of water from the approximately 99% water content of fan pump slurry to a fibrous web having approximately 72% water. The sheet former can take the form of a headbox, specially equipped with an atomizing spray bar for foam reduction, a continuous travelling wire screen mounted on table rolls, suction boxes, foils, and suction roll which remove water to produce a fibrous web. Alternatively, the sheet former can take the form of a wire-covered cylinder revolving in a vat of slurry, or a plurality of cylinder-containing vats for multiple deposition of layers. Other forms of the sheet former, such as the former sold by Sandy Hill, Inc., under the trade name "Deltaformer", can be used. Following formation of the continuous fibrous web on sheet former 54, it passes to press section 56 which removes water from the web to reduce the water content to about 50% to 60% by weight. Press section 56 has one or more nips comprising steel or rubber squeeze rolls for continuous pressing of the web, which then passes from press section 56 to saturator 58, which introduces the binder portion and additives, such as the components listed in Table II, into the web. Saturator 58 consists of a supporting screen receiving the web from press section 56 and carries the continuously travelling web through a saturating pan containing the binder portion and additives. Excess adhering binder portion and additives is removed by a set of steel squeeze rolls to which the web passes from the saturating pan. From saturator 58 the web passes to dryers 60, comprising pressurized steam-heated rotating metal cylinders which dry the web to a moisture content less than about 3% by weight. From dryers 60, the web passes to coating station 62, where water or other chemicals can optionally be applied to the top surface of the web. Coating station 62 can be a coater of various types, such as a floating knife coater, a knife over roll coater, or a spray coater. From coating station 62, the coated web is passed to calender stack 64, a bank of steel rolls through which the web passes to reduce web thickness and increase web smoothness and compactness. The product is received from calender stack 64 on windup reel 66, where the final product is wound on a turning rod to form a roll.

Several factors which affect the nature of the final product are the following: refining of the pulp in refiner 36 is carried out to give a satisfactory balance of web formation, drainage characteristics and saturability. Certain of the components of the fibrous portion and fibrous portion additives listed in Table I are incorporated therein, rather than in the binder portion and binder portion additives, such as the components listed in Table II, which are added at saturator 58. This is done because certain dyes, pigments, resins, antioxidants, and other additives tend to settle and tend to reduce the mechanical stability of the binder portion latex added at saturator 58. Since most of these materials have not readily adhered to the fiber in the wet state, hydrous aluminum oxide is added which acts as a retention aid. Over-all web composition from the fibrous and binder components is shown in Table III.

Water drainage and latex penetration increase with increasing web temperature and saturant temperature, and means are provided in sheet former 54 and in saturator 58 to maintain optimum operating temperatures.

The wet web is passed through saturator 58 under conditions which allow the web to absorb the binder portion and additives to the extent necessary to achieve the desired binder level in the finished web. As the web enters the saturating tank, it expands due to swelling action of the binder portion and additives. While under the surface of the bath, the web is compressed by a mold roll, and as it passes from under the mold roll, still below the surface of the bath, it expands to absorb the binder portion and additives throughout its entire thickness. The amount of binder portion and additives comprising the final dry weight of the web is determined by the concentration of saturant solids and by the pressure applied to the web by steel squeeze rolls of saturator 58.

Figure 3:
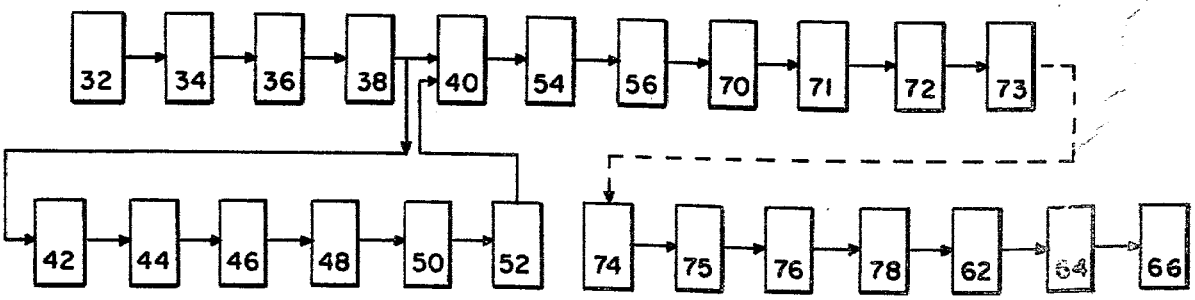
FIG. 3 is a block diagram showing steps for making a backing web of the present invention by dry web impregnation.

FIG. 3 shows the process of dry web impregnation, many steps of which are identical to those of wet web impregnation described above in connection with FIG. 2. For example, materials are introduced into the same equipment as far as press section 56, where the web emerges with a moisture content preferably from about 50 to 60% by weight of water. However, from press section 56, the web passes to dryers 70 in the dry web process illustrated in FIG. 3, following which calender stack 71 reduces web thickness and increases web smoothness and compactness, from which the non-impregnated web is collected on windup reel 72. A roll of non-impregnated web is built on a fiber core by rewinder 73 from web wound on windup reel 72. Further steps of the dry web impregnation process can be performed on equipment comprising a second production line separate from the equipment described above. The dotted line in FIG. 3 connecting rewinder 73 at the end of the first production line with unwind stand 74 at the beginning of the second production line infers that the production lines can be remote and separate within the same plant or can be situated at different locations, and the dotted line also infers a break in manufacturing continuity.

The roll from rewinder 73 is mounted on unwind stand 74 which is the beginning step of the second production line of the dry web impregnation process shown in FIG. 3. As the web unwinds from unwind stand 74, it passes through a saturator comprising saturator pan 75 and squeeze rolls 76. The web is floated through a bath in saturator pan 75 containing the binder portion and additives, followed by removal of excess bath material by squeeze rolls 76. From squeeze rolls 76, the saturated web passes to dryers 78, comprising a plurality of pressurized steam-heated rotating can which dry the web to less than 3% moisture. The first two cans are preferably maintained at about 200 degrees F., the last can is kept at ambient temperature, and other intermediate cans are preferably maintained at about 250 to 300 degrees F. The dried impregnated web is now passed to coating station 62 to calender stack 64 and windup reel 66, also identical with like components used in wet web impregnation.

Considerations to dry web impregnation are the following. The web base passing through saturator pan 75 must have sufficient web strength to permit pulling through the saturating bath of saturator pan 75 without rupturing of the web. Dry web impregnation is preferred for manufacturing impregnated webs of comparatively low gauge, for example, less than about 0.060 inches. The time permitted for the web to remain within the bath of saturator pan 75 should be sufficient to permit the web to absorb binder portion and additives to its maximum capacity. As a general rule, maximum solids content in the saturant bath of saturator pan 75 is desirable, with control of the degree of incorporation of saturant bath in the web effected by the pressure exerted by squeeze rolls 76. Migration of saturant to the surface of the web in driers 78 can occur, creating certain disadvantages, such as lowering of internal bond strength due to depletion of binder therein, trapping of moisture near the surface to give imperfections in the web, and stick of the web on manufacturing equipment, such as driers 78. Migration is minimized by maintaining a lower temperature on the first of a plurality of dryer cans comprising dryers 78.

Figure 4:
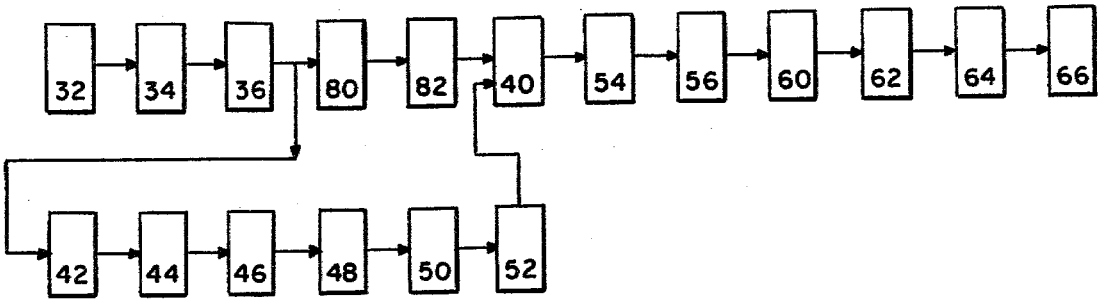
FIG. 4 is a block diagram showing steps in a method for making a backing web of the present invention by the latex beater deposition method.

FIG. 4 shows the latex beater deposition method of preparing the web of the present invention. While the glass fiber dispersion is prepared in the same manner as described above, remaining steps differ, as can be seen from FIG. 4. Slurry emerging from pulper 32, drop chest 34 and refiner 36 is prepared in the same manner as described above. However, the slurry from refiner 36, which has no glass fiber, passes into latex deposition chest 80, where the binder portion and additives are mixed with the slurry from refiner 36. A portion of the slurry from refiner 36 is pumped to glass fiber dispersion tank 42 for preparation of the glass fiber dispersion in the manner described above. In a batchwise manner, the binder portion and additives are mixed in latex deposition chest 80 with refined fiber slurry without glass fiber, entering latex deposition chest 80 from refiner 36. A deposition agent or combination of agents is added to latex deposition chest 80 which breaks the rubber latex emulsion and deposits rubbery particles uniformly on fibers. Optionally, the deposition agent or combination of agents may be added to latex deposition chest 80 before addition of the binder portion and additives, or may be added instead to the fibrous slurry in pulper 32. The slurry of fibrous components upon which binder components have been deposited then passes from latex deposition chest 80 to machine chest 82, which is a chest containing a stirrer and which also receives edge trim cut from the web made on sheet former 54. Slurry from machine chest 82 is applied to fan pump 40. Glass fiber dispersion from a dispersion feed tank 50 is pumped by pump 52 to the inlet of fan pump 40 for mixing and for forming into a web by sheet former 54, press section 56, dryers 60, coating station 62, calender stack 64, and windup reel 66 in the same manner as described for these steps for web web impregnation in FIG. 2 hereinabove. It is to be noted that the saturator 58, present in FIG. 2 between press 56 and dryers 60, is absent in FIG. 4, since its function in the latex beater deposition process illustrated in FIG. 4 is carried out at an earlier stage of the process.

Figure 5:
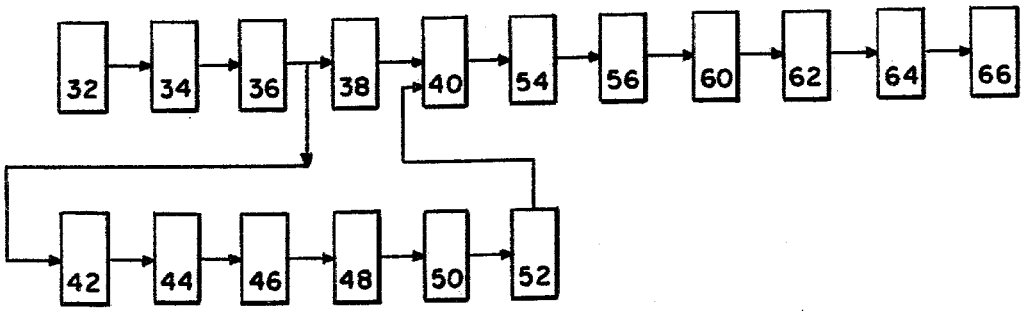
FIG. 5 is a block diagram illustrating steps in a method for making a backing web by the continuous latex wet-end deposition method.

FIG. 5 illustrates the continuous latex wet-end deposition method of producing the web of the present invention. Many steps of this process are the same as those described for latex beater deposition. A slurry of fibrous portion and additives, without glass fiber, is prepared in pulper 32. A deposition agent or combination of agents may be added to the slurry in pulper 32, or these agents may be introduced at a later stage in the process. The slurry is pumped to drop chest 34 and then through refiner 36 at which point a minor portion of slurry is pumped to glass fiber dispersion tank 42 for preparation of glass fiber dispersion in the manner described above for the latex beater deposition method. The major portion of fibrous slurry is pumped to machine chest 38, which is a chest containing a stirrer and which also receives edge trim cut from the web made on sheet former 54. Slurry from machine chest 38 passes to fan pump 40 where it is diluted with recycled mill water. Glass fiber dispersion from dispersion feed tank 50 is supplied to the inlet of fan pump 40 by pump 52. A deposition agent or combination of agents may optionally be supplied to the inlet of fan pump 40 instead of in pulper 32. The fibrous slurry and glass fiber dispersion are mixed in fan pump 40. The binder portion and binder portion additives are fed continuously to the combinded fibrous slurry and glass fiber dispersion at any one of several locations prior to formation of the web.

Optionally, the binder portion and binder portion additives may be introduced at the inlet to fan pump 40, where in the presence of a deposition agent or combination of agents, the rubber latex emulsion breaks depositing rubbery particles uniformly on fibers. The slurry of fibers with deposited rubber passes to sheet former 54, where formation of a web takes place. The web from sheet former 54 passes to press section 56, dryers 60, coating station 62, calender stack 64, and windup reel 66 in an identical manner to that described above in FIG. 4 for the latex heater deposition process.

A second location for continuous addition of binder portion and binder portion additives is possible if sheet former 54 is of the type having a headbox, which may be one of several types sold under various trademarks such as Fourdinier, Harper Fourdrinier, Deltaformer, Rotoformer, Inverform, Twinverform, Verti-Forma, Bel Baie Former, and others. The combined fibrous slurry and glass fiber dispersion in fan pump 40 is pumped to the headbox in sheet former 54. The binder portion and binder portion additives are continuously fed to the headbox of sheet former 54, where they are mixed with the combined fibrous slurry and glass fiber dispersion. In the presence of a deposition agent or combination of agents, deposition of binder on fibers occurs as described in the paragraph above. Optionally, the deposition agent or combination of agents may be added to the headbox of sheet former 54. The web is then formed and processed in the manner described above.

A third location for continuous addition of binder portion and binder portion additives may be used if sheet former 54 is a cylinder machine. The binder portion and binder portion additives may be added in a continuous manner to the pipe line feeding combined fibrous slurry, glass fiber dispersion, and deposition agent, from fan pump 40 to the cylinder-containing vat, or a plurality of cylinder-containing vats of sheet former 54. Deposition of binder on fibers, and web formation and processing proceeds in the same manner as above.

The continuous latex wet-end deposition method differs from the latex beater deposition method in that the binder portion and binder portion additives are introduced continuously, rather than in a batchwise manner used for the latter method. For both deposition methods, optimum results are obtained when the rubber binder latex is added as dilute as possible, at a point at which there is sufficient agitation.

Comparative samples were prepared for testing the composition and method of the present invention. One sample typical of the composition of the present invention (Sample A) was prepared by the wet web impregnation technique, as illustrated by FIG. 2 and described above. Another sample (Sample B) was prepared as a control, not having the components necessary for the present invention, by the same wet web impregnation technique and of the same thickness as Sample A. Sample A was prepared from a fibrous portion and fibrous portion additives identified above as Example III, while Sample B was prepared from that identified as Example IV (see Table IV). Sample A was prepared from a binder portion and binder portion additives identified as Example VIII, while Sample B was prepared from that identified as Example IX (See Table V). Table VI summarized the preparation and properties of Samples A and B.

Properties of the cellulosic backing web formed by the processes described above are determined by test procedures which demonstrate the superiority of the backing web of the present invention. Table VII lists in summary form tests applied to Samples A and B, according to the procedures identified below as Procedures A through G. Certain tests are best applied to the web backing alone, while other tests are only applicable to the backing web when combined in a finished flooring product.

Such tests of the web alone are particularly indicative of utility of the web in applications such as chart paper, wall covering, visor board, or the like. While all tests are pertinent to use of the web when associated with a surface coating, certain tests listed in Table VII were carried out with a web combined in a floor covering product, illustrating performance of Sample A and Sample B when so used. Table VIII lists properties tested by procedures described below, showing measured values for Sample A, a backing web prepared according to the present invention and having acceptable properties. Comparative values for Sample B are also shown. In Table VIII and in the discussion below, properties vary according to the direction measured with respect to the direction of travel of the web during manufacture. Measurements made in the machine direction, or along the length of a strip of web as manufactured will be referred to by the abbreviation MD; measurements in the cross-machine direction perpendicular to the machine direction will be abbreviated CD; and properties measured in the diagonal direction at 45 degrees from the MD or the CD will be abbreviated DD.

PROCEDURE A

Dimensional stability with soaking is tested by preparing square test pieces which are cut parallel to the edge of the backing web and conditioned for a minimum of 18 hours at 50% relative humidity at a temperature of 73 degrees F. (ASTM D641 Standard Atmosphere Conditions). Marks at measured distances are scribed on the test samples in the machine direction (MD), cross-machine direction (CD), and diagonal direction (DD). The distance between marks is referred to as the original length.

Test pieces are heated for 2 minutes at 356 degrees F. in an air circulating oven, and then after removal, the distance between marks is measured. Percent dimensional change from the original length is calculated. The same test specimens are conditioned at 50% relative humidity at a temperature of 73 degrees F. for 2 hours; distance between marks is measured; and dimensional change from the original length is calculated. The test pieces are then soaked in distilled water at ambient temperature for 5 minutes, removed, blotted, the distance between marks measured, and the dimensional change from the original length calculated. The test speciments are allowed to air dry for 18 hours at the above ASTM conditions, the distance between marks measured, and dimensional change from the original length calculated. Some results of the test represent shrinkage of the sample (designated by negative values), and some represent growth of the sample (designated by positive values). The maximum range of dimensional change, either of greatest shrinkage, greatest growth, or the sum of the greatest shrinkage and greatest growth is also noted and listed in Table VIII.

PROCEDURE B

Dimensional stability without soaking is measured by a separate test.

Test pieces are cut, conditioned, and marked in the machine direction and cross-machine direction in an identical manner to Procedure A. The specimens are heated for 1 hour at 180 degrees F. in an air circulating oven, conditioned for 1 hour at 50% relative humidity at a temperature of 73 degrees F., distance between marks measured, and dimensional change from the original length calculated. The same test pieces are placed in a 100% relative humidity chamber at a temperature of 73 degrees F. for 48 hours, removed, distance between marks measured and dimensional change from the original length calculated. Test pieces are conditioned for 24 hours at 50% relative humidity at a temperature of 73 degrees F., and dimensional changes from the original length determined in the same manner as above.

PROCEDURE C

Resistance to excessive stiffening, embrittlement, and discoloration from heat at the processing temperatures or resilient floor covering manufacture is determined by the following tests. Test specimens, cut 2.75×1.50 inches in both the machine direction and cross-machine direction are conditioned for a minimum of 18 hours at 50% relative humidity at a temperature of 73 degrees F. (ASTM D641 Standard Atmosphere Conditions). Taber stiffness values are measured according to TAPPI Standard Method T489 os-76. Test pieces are then subjected to a temperature of 380 degrees F. for 3 minutes in an air circulating oven, followed by conditioning at 50% relative humidity at a temperature of 73 degrees F. for a minimum of 18 hours. Taber stiffness measurements are then made. Samples are examined visually for any color changes vs. an unheated control piece. Each test specimen is bent 180 degrees and embrittlement is determined visually as evidenced by signs of breaking, surface cracking, etc.

PROCEDURE D

Resistance against typically encountered strains of fungi is measured by the following test. Samples of backing web are placed on the surface of nutrient-salt agar and inoculated with a mixed spore suspension of Aspergillus niger, Penicillium funiculosum, Chaetomium globosum, Trichoderma sp, and Pullularia pullulans according to ASTM Test Method G21-70. The specimens are incubated at 83–86 degrees F. and not less than 85% relative humidity for 28 days. Samples are then evaluated visually for growth using a rating scale described in ASTM G21-70.

PROCEDURE E

Indentation resistance is measured by the following test. Samples of backing web are subjected to compression by a penetrator foot of 0.178 inch diameter for a period of 30 seconds with a weight load of 90 lb. In a separate test a weight load of 140 lb. is used. Initial indentation is measured in 1/100 mm. Samples are allowed to recover, without load for 1 hour and residual indentation is measured in 1/100 mm.

PROCEDURE F

Resistance to high humidity curling when a web backing is combined in a resilient floor covering product is measured by the following test. Strips of resilient floor covering product, 7×1 inch, cut in machine and cross-machine directions, are conditioned for 6 days at 100% relative humidity at a temperature of 73 degrees F. Each strip is removed from the conditioning chamber and placed on a glass plate. The height of the ends of the sample above the plane of the glass is measured in 64th of an inch. Average height of the two ends is reported.

PROCEDURE G

Delamination resistance of a web backing when combined in a resilient floor covering product is measured by the following test. A floor covering sample, backing web side down, is attached to a wooden plate with latex cement, allowing 48 hours drying time. The wooden plate is mounted on a rotor with a speed of 20 revolutions per minute. An assembly of three standard caster wheels with total weight load of 50 kg is placed on top of the floor covering sample. In a separate test, a load of 90 kg is placed on the sample. The assembly is rotated at 50 revolutions per minutes in a direction opposite to that of the wooden plate. The test is continued for 10,000 rotations or until delamination of the floor covering sample occurs, the number of the rotations of the wooden plate being recorded.

It is clear from the test results of Table VIII that a high degree of dimensional stability characterizes the backing web of the present invention. To manufacture a resilient floor covering product as shown on FIG. 1, backing web 10 is first made according to the process of the present invention. Foam layer 16 can contain a blowing or foaming agent, such as described in U.S. Pat. No. 3,293,094 to Nairn et al, listed above, or can be mechanically foamed, as is described in U.S. Pat. No. 1,852,447 to Chapman.

In a typical floor covering manufacturing process, a knife over roll coater is used to apply a plastisol containing powdered resin, plasticizer, a blowing or foaming agent, and stabilizers to backing web 10. The plastisol coating is gelled by passing the web 10 through an oven equipped with suitable means for applying top heat to the plastisol coating so that a gelling temperature of approximately 200–230 degrees F. is achieved. This gelled plastisol coating is the precursor of foam layer 16.

Decorative print layer 14 can be applied by an conventional printing means, such as a silk screen apparatus, a flat bed printing machine of the type commonly used in the smooth surface flooring industry, or a conventional rotogravure press with etched cylinders which apply a suitable ink to foam layer 16 to comprise decorative print layer 14.

A plastisol precursor of wear layer 12 is applied to decorative print layer 14 by suitable means such as a reverse roll coater. The resulting composite of backing web 10, precursor of foam layer 16, decorative print layer 14, and the precursor of wear layer 12 is transported through a gas fired air circulating oven with an increasing temperature gradient. Changes in the above composite occur in the following order at progressively increasing oven temperatures. First, the precursor of wear layer 12 is gelled. Second, the blowing agent in the precursor of foam layer 16 decomposes to produce a cellular structured foam layer 16 by generation of gas bubbles. Third, when the composite reaches the final oven zone, which is at about 380–400 degrees F., foam layer 16 and wear layer 12 are fused by the dissolution of resin in plasticizer.

Although not illustrated in FIG. 1, an embossing procedure applicable to foamable compositions can be used to provide a textured or embossed surface, and embossed areas can be in register with a printed design. An embossing method is described in U.S. Pat. No. 3,293,094 to Nairn et al.

Preferably, a synthetic fiber with a melting point of from about 230 degrees F. to about 380 degrees F. is selected when a resilient layered floor covering product is to be made from the present invention, such as the material illustrated in FIG. 1. Examples of a synthetic fiber with a melting point of from about 230 degrees F. to about 380 degrees F. are polyethylene and polypropylene. The synthetic fiber is included in the fibrous components used to make the backing web. When the flooring product is manufactured in the typical equipment described above, it passes into the oven at final temperature of about 380–400 degrees F., where the synthetic fibers in the backing web melt in a manner to encase the cellulosic fibers, glass fibers, and calcium silicate mineral fibers in the backing web. The result is a flooring product with enhanced dimensional stability, and furthermore, with increased indentation resistance, particularly increased residual indentation resistance.

While test results have been directed specifically to use of the cellulosic backing web of the present invention for a resilient floor covering product, and while the invention has been particularly described with reference thereto, it is contemplated that many applications of the present invention exist. Examples of uses for the backing web of the present invention include, in addition to its use as a backing for a resilient floor covering or linoleum, use as a wall covering, gasketing, shoe insoles, visor board, a hat brim liner, map paper, chart and meter paper, backing for a belt or other item of apparel, automotive interior backing board, filters, backing for artificial leather, acoustical board, packaging, and other uses. The backing web of the present invention can be used in various thicknesses ranging from about 0.006 inch to about 0.150 inch, preferably from about 0.010 inch to about 0.120 inch, more preferably from about 0.015 inch to about 0.060 inch, and most preferably from about 0.018 inch 0.050 inch. Using the latex beater deposition method or the continuous latex wet-end deposition method, thickness can range from about 0.003 inch to about 0.150 inch.

Many useful articles can be made from the backing web alone, as exemplified below.

An improved gasketing material or filter material can be made from the backing web of the present invention, having improved dimensional stability, flexibility, and other properties, and with the advantage of asbestos-free construction.

An improved paper can be made from the backing web of the present invention with improved dimensional stability under various temperature and humidity conditions as well as soaking in water. Such dimensional stability under various circumstances of use is important for papers such as for chart paper, where preservation of the size and shape of inserted charted information is important; for map paper, where maintanance of the relative location of map symbols is important; and for graph paper, where it is important to preserve and maintain graphed data in its location as originally drawn. The paper of the present invention offers all the advantages resulting from an asbestos-free formulation as listed above. Although backing webs of a thickness from about 0.006 inch to about 0.150 inch can be made by the wet web impregnation, the dry web impregnation, the latex beater deposition, or the continuous latex wet-end deposition methods described above, and such webs can be used as chart, map, or graph paper, such papers with a thickness as low as 0.003 inch can be manufactured by the present invention by the latex beater deposition or continuous latex wet-end deposition methods.

Papers made from the cellulosic backing web of the present invention have greater resistance to edge tearing, tearing along fold lines, and tearing when moist or wet than cellulosic papers manufactured with glass fibers but without the rubber binder of the present invention.

Acoustical board or packaging material can be made from the backing web of the present invention and such materials have improved dimensional stability and have the advantage of asbestos-free construction.

Visor board or brim material for incorporation in wearing apparel such as headwear in the form of hats, caps, eyeshades, and the like, can be made from the backing web of the present invention. Such articles have dimensional stability, as well as wearability when constructed of a backing web manufactured according to the present invention.

Insoles for footwear can be made of the web of the present invention, such insoles having greater dimensional stability and curl resistance than conventional shoe insoles, resulting in a product which is especially suitable for footwear where interior soaking or heavy moistening by foot perspiration occurs, such as for athletic shoes, sportsmen's boots, military footwear, and other similar applications.

Battery separators can be made from the web of the present invention, particularly from a web made with a binder of phenolic resin. The preferred thickness of web for use as a battery separator is about 0.006 inch to about 0.035 inch.

Shoe counters can be made from the web of the present invention, preferably made from a material from a thickness of about 0.020 inch to about 0.150 inch.

TABLE I

Composition of Fibrous Portion and Additives

| Component | Dry Weight Percent |
|---|---|
| Cellulosic Fiber | 40–95% |
| Glass Fiber | 3–35% |
| Synthetic Fiber | 0–56% |
| Calcium Silicate Mineral Fiber | 0–40% |
| Antifungal and Antimildew Agent | 0.5–2.0% |
| Zinc Oxide | 0–4% |
| Sulfur | 0–2% |
| Zinc Diethyldithiocarbamate | 0–2% |
| Zinc 2-Mercaptobenzothiazole | 0–1% |
| Dyes or Pigments | 0–5% |
| Dispersant | 0–1% |
| Hydrous Aluminum Oxide | 0–2.5% |

TABLE II

Composition of Binder Portion and Additives

| Component | Dry Weight Percent |
|---|---|
| Natural Rubber Latex Synthetic Rubber Latex or Mixtures thereof, or Phenolic Resin | 90–100% |
| Petroleum Wax Emulsion | 0–10% |
| Stearylated Melamine Emulsion | 0–10% |
| Surfactants and Stabilizers | 0–2% |
| Antioxidant | 0–3% |
| Ammoniated Casein | 0–1% |

TABLE III

Composition of Backing Web

| Component | Dry Weight Percent |
|---|---|
| Fibrous portion and fibrous portion additives | 50–88% |
| Binder portion and binder portion additives | 12–50% |

TABLE IV

Formulations of Fibrous Portion and Fibrous Portion Additives

| Component | Dry Weight Percent | | | |
|---|---|---|---|---|
| | Example I | Example II | Example III Sample A | Example IV Sample B |
| Wood pulp | 92.0 | 44 | 55.1 | 98.3 |
| Glass fiber | 4.8 | 8.5 | 5.5 | — |

TABLE IV-continued

Formulations of Fibrous Portion and Fibrous Portion Additives

| Component | Dry Weight Percent | | | |
|---|---|---|---|---|
| | Example I | Example II | Example III Sample A | Example IV Sample B |
| Calcium silicate mineral fiber | — | 22 | 18.4 | — |
| Polyethylene fiber | — | — | 18.4 | — |
| Polyester fiber | — | 22 | — | — |
| Antifungal agent | 1.4 | 1.6 | 0.9 | — |
| Dyes and pigments | 0.06 | 0.01 | 0.06 | 0.06 |
| Dispersant | 0.04 | — | 0.04 | 0.04 |
| Hydrous aluminum oxide | 1.7 | 1.9 | 1.6 | 1.6 |
| | 100.0 | 100.0 | 100.0 | 100.0 |
| Total Fibrous Portion and Fibrous Portion Additives as Dry Weight Percent of Backing Web | 75 | 80 | 77 (Sample A) | 78 (Sample B) |

TABLE V

Formulations of Binder Portion and Binder Portion Additives

| Component | Ex. V | Ex. VI | Ex. VII | Ex. VIII (Sample A) | Ex. IX (Sample B) |
|---|---|---|---|---|---|
| Poly-n-butyl acrylate rubber latex | 95.0 | — | — | — | — |
| Carboxylated styrene-butadiene rubber latex | — | 92.5 | — | — | 87.7 |
| Polychloroprene rubber latex | — | — | 92.6 | — | — |
| Styrene-butadiene rubber latex | — | — | — | 92.6 | — |
| Antioxidant | — | 1.9 | 1.9 | 0.9 | 0.9 |
| Nonionic surfactant | — | 0.5 | 0.9 | — | 0.5 |
| Stearylated melamine emulsion | 5.0 | — | 3.7 | 4.6 | — |
| Glycerine | — | — | — | — | 5.2 |
| Ammoniated casein | — | 0.5 | 0.9 | — | 0.5 |
| Ammonium sulfate | — | — | — | — | 5.2 |
| Petroleum wax emulsion | — | 4.6 | — | 1.9 | — |
| | 100.0 | 100.0 | 100.0 | 100.0 | 100.0 |
| Total Binder Portion and Binder Portion Additives as Dry Weight Percent of Backing Web | 19 | 24 | 28 | 23 (Sample A) | 22 (Sample B) |

TABLE VI

Preparation and Properties of Backing Web Samples

| Sample | Composition of Fibrous Portion | Composition of Binder Portion | Method of Manufacture | Thickness (inches) | Weight (lbs. per sq. yard) |
|---|---|---|---|---|---|
| Improved Web (Sample A) | Example III | Example VIII | Wet Web Impregnation | 0.025 | 0.73 |
| Control (Sample B) | Example IV | Example IX | Wet Web Impregnation | 0.025 | 0.75 |

TABLE VII

Tests Applied to Samples

| Configuration of Sample | Property Tested | Procedure | Unit of Test Results |
|---|---|---|---|
| | Dimensional | | |

TABLE VII-continued

| Configuration of Sample | Tests Applied to Samples: Property Tested | Procedure | Unit of Test Results |
|---|---|---|---|
| Web alone | stability (soaking) | A | Percent change from original length |
| Web alone | Dimensional stability (without soaking) | B | Percent change from original length |
| Web alone | Resistance to stiffening (Taber Stiffness) | C | g-cm |
| Web alone | Embrittlement | C | Observation |
| Web alone | Discoloration | C | Observation |
| Web alone | Fungi resistance | D | Rating scale |
| Web alone | Indentation resistance | E | 1/100 mm |
| Web combined in floor covering product | Resistance to high humidity curling (7 × 1 inch strips) | F | 1/64 inch units |
| Web combined in floor covering product | Delamination resistance | G | Rotation to delamination |

TABLE VIII

| Property | Procedure | Direction | Sample A | Sample B |
|---|---|---|---|---|
| Results of Sample Tests | | | | |
| Dimensional stability | A | | | |
| 2 min. at 356° F. | A | MD | −0.16 | −0.15 |
| " | A | CD | −0.08 | −0.21 |
| " | A | DD | −0.19 | −0.17 |
| 2 hrs. @ 50% RH 73° F. | A | MD | −0.09 | −0.07 |
| " | A | CD | +0.02 | +0.36 |
| " | A | DD | +0.07 | +0.10 |
| 5 min. soak in $H_2O$ | A | MD | −0.06 | +0.05 |
| " | A | CD | +0.32 | +1.70 |
| " | A | DD | +0.07 | +0.83 |
| 18 hrs. @ 50% RH 73° F. | A | MD | −0.38 | −0.65 |
| " | A | CD | −0.16 | −0.73 |
| " | A | DD | −0.34 | −0.56 |
| Maximum range of dimensional change for testing cycle | A | MD | 0.38 | 0.70 |
| | A | CD | 0.48 | 2.43 |
| | A | DD | 0.41 | 1.39 |
| Dimensional stability | B | | | |
| 1 hr. @ 180° F., 1 hr. | B | MD | 0.00 | −0.16 |
| @ 50% RH 73° F. | B | CD | 0.00 | −0.31 |
| 48 hrs. @ 100% RH 73° F. | B | MD | 0.00 | +0.67 |
| " | B | CD | +0.47 | +1.41 |
| 24 hrs. @ 50% RH 73° F. | B | MD | 0.00 | +0.21 |
| " | B | CD | 0.00 | +0.63 |
| Stiffening resistance | C | | | |
| 18 hrs. 50% RH 73° F. | C | MD | 91 | 103 |
| " | C | CD | 44 | 52 |
| 3 min. 380° F. 18 hrs. | C | MD | 109 | 224 |
| @ 50% RH 73° F. | C | CD | 58 | 116 |
| Embrittlement | C | — | No observed breaking or surface cracking. | Sample cracked, breaking of outer surface. |
| Discoloration | C | — | Slight change in shade; no yellowing, brown, black or dark red discoloration. | Brown discoloration. |
| Fungi Resistance | D | — | 0 (no growth) | 3 (medium growth, 30-60% coverage. |
| Indentation Resistance | E | — | | |
| Initial indentation(90 lb) | | | 24 | 31 |
| Initial indentation(140 lb) | | | 26 | 33 |
| Residual indentation(90 lb) | | | 10 | 19 |
| Residual indentation(140 lb) | | | 15 | 23 |
| Curling Resistance | F | MD | 1.5 | 13.0 |
| | | CD | 5.0 | 23.0 |
| Delamination Resistance | G | | | |
| Load of 50 kg | | — | greater than 10,000 | 900 |
| Load of 90 kg | | — | 1,000 | 300 |

MD - test in machine direction
CD - test in cross-machine direction
DD - test in diagonal direction The foregoing is considered as illustrative only of the principles of the invention. Further, since numerous modifications and changes will readily occur to those skilled in the art, it is not desired to limit the invention to the exact construction and operation shown and described, and accordingly, all suitable modification and equivalents may be resorted to, falling within the scope of the invention.

What is claimed as new is as follows:

1. An asbestos free backing web having a thickness from about 0.015 inch to about 0.060 inch, prepared from fibrous component's and binder components, said fibrous components being present from about 50% to about 88% of dry weight of said backing web and comprising a fibrous portion and fibrous portion additives, said binder components being present from about 50% to about 12% of dry weight of said backing web and comprising a binder portion and binder portion additives, said fibrous components including cellulosic fiber in an amount from about 40% to about 85%, glass fiber in an amount from about 3% to about 35%, polyolefin fiber having a melting point in the range of about 230° F. to about 380° F. in an amount from about 10% to about 56%, and antifungal-antimildew agent in an amount from about 0.5% to about 2.0% all with respect to the dry weight of fibrous components, said binder components including a synthetic rubber latex or combination of latices, said web having dimensional stability in the machine direction, the cross machine direction and the diagonal direction such that the web in these directions varies in dimension by not more than about 0.5% when subjected to relative humidity changes in the range of relative humidity of 0% to 100%, or when subjected to water soaking with respect to the complete range of relative humidity, said web also exhibiting no visible fungal growth after a 28 day incubation period at 83°-86° F. and not less than 85% relative humidity, the web having been placed at the start of said period on the surface of nutrient-salt agar and inoculated with a mixed spore suspension of *Aspergillus niger, Penicillium funicolosum, Chaetomium globosum, Trichloderma sp,* and *Pullularia pullulans,* whereby said web is characterized by resistance to stiffening, embrittlement, thermal discoloration and permanent indentation.

2. The backing web of claim 1, wherein said fibrous components include glass fiber in an amount from about 3% to about 15% of dry weight of said fibrous components.

3. The backing web of claim 1, wherein said fibrous components include glass fiber in an amount from about 3% to about 9% of dry weight of said fibrous components.

4. The backing web of claim 2, wherein said fibrous components include, in addition, calcium silicate mineral fiber in an amount from about 10% to about 40% of dry weight of said fibrous components.

5. The backing web of claim 1, wherein said fibrous components include, in addition, calcium silicate mineral fiber in an amount from about 10% to about 40% of dry weight of said fibrous components.

6. The backing web of claim 1, wherein said polyolefin fiber is polyethylene fiber or polypropylene fiber or a mixture thereof.

7. The backing web of claim 6, wherein said fibrous components include, in addition, calcium silicate mineral fiber in an amount from about 10% to about 40% of dry weight of said fibrous components.

8. The backing web of claim 1, wherein said synthetic rubber latex or said combination of latices is selected from the group consisting of a styrene-butadiene copolymer, a carboxylated styrene-butadiene copolymer, a polyacrylic ester, polyvinyl acetate, vinyl acetate-acrylic ester copolymer, polychloroprene, acrylonitrile-butadiene copolymer, carboxylated acrylonitrile-butadiens copolymer, a polyurethane, an ethylene-vinyl acetate copolymer, polyisobutylene, acrylonitrile-acrylic ester copolymer, polymethacrylic ester, and a copolymer of acrylic ester and methacrylic ester.

9. The backing web of claim 8, wherein said synthetic rubber latex is poly-n-butyl acrylate rubber.

10. The backing web of claim 8, wherein said synthetic rubber latex is carboxylated styrene-butadiene copolymer.

11. The backing web of claim 8, wherein said synthetic rubber latex "neoprene" is polychloroprene.

12. The backing web of claim 8, wherein said synthetic rubber latex is styrene-butadiene copolymer.

13. The backing web of claim 1, wherein said binder portion additives include stearylated melamine emulsion in an amount from about 0.2% to about 10% of dry weight of said binder components.

14. The backing web of claim 1 wherein a foam layer, a decorative print layer, and an outer wear-resistant layer are applied to one surface of said backing web, whereby said polyolefin fiber of said fibrous components fuses at the application temperature of said foam, print and outer wear-resistant layers resulting in increased bonding strength, whereby said backing web is characterized by enhanced delamination resistance.

15. The backing web of claim 6, wherein said polyolefin is fused to said fibrous components and said binder components.

16. The backing web of claim 12 comprising 77% of said fibrous portion and fibrous additives and 23% of said binder portion and binder portion additives measured by dry weight of backing web, said fibrous portion and fibrous portion additives comprising:

wood pulp—55.1%
glass fiber—5.5%
calcium silicate mineral fiber—18.4%
polyethylene fiber—18.4%
antifungal agent—0.9%
dyes and pigments—0.06%
dispersant—0.04%
hydrous aluminum oxide—1.6% and said binder portion and binder portion additives comprising:

Styrene-butadiene rubber latex—92.6%
antioxidant—0.9%
stearylated melamine emulsion—4.6%
petroleum wax emulsion—1.9%.

17. The backing web of claim 1, wherein said binder portion additives include petroleum wax emulsion in an amount from about 0.2% to about 10% of dry weight of said binder components.

18. A wet web impregnation method of manufacturing an asbestos-free backing web having a thickness from about 0.010 inch to about 0.120 inch, said web having fibrous portion and fibrous portion additives present from about 50% to about 88% of dry weight of backing web and having binder portion and binder portion additives present from about 50% to about 12% of dry weight of backing web, said fibrous portion and fibrous portion additives including cellulosic fiber in an amount from about 40% to about 85%, glass fiber in an amount from about 3% to about 35%, polyolefin fiber having a melting point in the range of about 230° F. to about 380° F. in an amount from about 10% to about 56%, and antifungal-antimildew agent in an amount from about 0.5% to about 2.0% all with respect to the dry weight of said fibrous portion and fibrous portion additives, said binder portion and binder portion additives including a synthetic rubber latex or combination of latices, said web having dimensional stability in the machine direction, the cross machine direction and the diagonal direction such that the web in these directions varies in dimension by not more than about 0.5% when subjected to relative humidity changes in the range of relative humidity of 0% to 100%, or when subjected to water soaking with respect to the complete range of relative humidity, said web also exhibiting no visible fungal growth after a 28 day incubation period at 83°-86° F. and not less than 85% relative humidity, the web having been placed at the start of said period on the surface of nutrient-salt agar and inoculated with a mixed spore suspension of *Asperigillus niger, Penicillium funiculosum, Chaetomium globosum, Trichloderma sp,* and *Pullularia pullulans,* and comprising the steps of pumping with a fan pump a slurry of said fibrous portion and fibrous portion additives to a sheet former forming a web, pressing in a press section said web, which is then saturated in a saturator with said binder portion and binder portion additives, dried by dryers, compacted on a plurality of steel rolls, and wound on a windup reel, and wherein all components of said fibrous portion and fibrous portion additives except said glass fiber are dispersed in water in a pulper, stirred in a drop chest, macerated in a refiner, and retained in a machine chest, wherein the improvement comprises furnishing a portion of the output of said machine chest to a glass fiber dispersion tank partially filled with water at ambient temperature, and furnishing the remainder of said machine chest output to said fan pump, filling said glass fiber dispersion tank with water at ambient temperature, introducing said glass fiber in portions with stirring to said glass fiber dispersion tank to form a glass fiber dispersion, pumping said glass fiber dispersion to a dispersion holding tank, pumping said glass fiber dispersion from said dispersion holding tank to a dispersion feed tank, and pumping said glass fiber dispersion from said dispersion feed tank to said fan pump, where mixing with the output of said machine chest forms said fibrous portion and fibrous portion additives slurry.

19. The improvement of claim 18, wherein said backing web has a thickness from about 0.015 inch to about 0.060 inch.

20. The improvement of claim 18, together with the additional steps of applying a foam layer, a decorative print layer, and an outer wear-resistant layer to one surface of said backing web after the web is wound on the windup reel, whereby said polyolefin fiber of said fibrous portion and fibrous portion additives of said backing web fuses at the application temperature of said foam, print, and outer wearresistant layers resulting in increased bonding strength, whereby said backing web is characterized by enhanced delamination resistance.

21. The improvement of claim 18, wherein the pulping step and the saturating step are carried out with quantities such that the material formed comprises 77% of said fibrous portion and fibrous portion additives and 23% of said binder portion and binder portion additives, measured by dry weight of backing web, said fibrous portion and fibrous portion additives comprising:

wood pulp—55.1%
glass fiber—5.5%
calcium silicate mineral fiber—18.4%
polethylene fiber—18.4%
antifungal agent—0.9%
dyes and pigments—0.06%
dispersant—0.045
hydrous aluminum oxide—1.6% and said binder portion and binder portion additives comprising:

styrene-butadiene rubber latex—92.6%
antioxidant—0.9%
stearylated melamine emulsion—4.6%
petroleum wax emulsion—1.9%.

22. A dry web impregnation method of manufacturing an asbestos-free backing web having a thickness from about 0.006 to about 0.060 inch, said web having fibrous portion and fibrous portion additives present from about 50% to about 88% of dry weight of backing web and having binder portion and binder portion additives present from about 50% to about 12% of dry weight of backing web, said fibrous portion and fibrous portion additives including cellulosic fiber in an amount from about 40% to about 85%, glass fiber in an amount from about 3% to about 35%, polyolefin fiber having a melting point in the range of about 230° F. to about 380° F. in an amount from about 10% to about 56%, and antifungal-antimildew agent in an amount from about 0.5% to about 2.0% all with respect to the dry weight of said fibrous portion and fibrous portion additives, said binder portion and binder portion additives including a synthetic rubber latex or combination of latices, said web having dimensional stability in the machine direction, the cross machine direction and the diagonal direction such that the web in these directions varies in dimension by not more than about 0.5% when subjected to relative humidity changes in the range of relative humidity of 0% to 100%, or when subjected to water soaking with respect to the complete range of relative humidity, said web also exhibiting no visible fungal growth after a 28 day incubation period at 83°-86° F. and not less than 85% relative humidity, the web having been placed at the start of said period on the surface of nutrient-salt agar and inoculated with a mixed spore suspension of *Aspergillus niger, Penicillium funiculosum, Chaetomium globosum, Trichloderma sp, and Pullularlia pullulans,* and comprising the steps of pumping with a fan pump a slurry of said fibrous portion and fibrous portion additives to a sheet former forming a web, pressing in a press section said web, which is then dried by dryers, compacted on a plurality of steel rolls, wound on a windup reel, built on a core by a rewinder, unwound on an unwind reel, saturated with a saturant of said binder portion and binder portion additives in a saturator, pressed by squeeze rolls, dried by dryers, the product from said dryers passing to a calender stack and then to a windup reel on which the product is wound, and wherein all components of said fibrous portion and fibrous portion additives except said glass fiber are pulped in water in a pulper, stirred in a drop chest, macerated in a refiner, and retained in a machine chest, wherein the improvement comprises furnishing a portion of the output of said machine chest to a glass fiber dispersion tank partially filled with water at ambient temperature, and furnishing the remainder of said machine chest output to said fan pump, filling said glass fiber dfispersion tank with water at ambient temperature, introducing said glass fiber in portions with stirring to said glass fiber dispersion tank to form a glass fiber dispersion, pumping said glass fiber dispersion to a dispersion holding tank, pumping said glass fiber dispersion from said dispersion holding tank to a dispersion feed tank, and pumping said glass fiber dispersion from said dispersion feed tank to said fan pump, where mixing with the output of said machine chest forms said fibrous portion and fibrous portion additives slurry.

23. The improvement of claim 22, wherein said backing web has a thickness from about 0.018 inch to about 0.050 inch.

24. A latex beater deposition method of manufacturing an asbestos-free backing web having a thickness from about 0.003 inch to about 0.150 inch, said web having fibrous portion and fibrous portion additives present from about 50% to about 88% of dry weight of backing web and having binder portion and binder portion additives present from about 50% to about 12% of dry weight of backing web, said fibrous portion and fibrous portion additives including cellulosic fiber in an amount from about 40% to about 85%, glass fiber in an amount from about 3% to about 35%, polyolefin fiber having a melting point in the range of about 230° F. to about 380° F. in an amount from about 10% to about 56%, and antifungal-antimildew agent in an amount from about 0.5% to about 2.0% all with respect to the dry weight of said fibrous portion and fibrous portion additives, said binder portion and binder portion additives including a synthetic rubber latex or combination of latices, said web having dimensional stability in the machine direction, the cross machine direction and the diagonal direction such that the web in these directions varies in dimension by not more than about 0.5% when subjected to relative humidity changes in the range of relative humidity of 0% to 100%, or when subjected to water soaking with respect to the complete range of relative humidity, said web also exhibiting no visible fungal growth after a 28 day incubation period at 83°-86° F. and not less than 85% relative humidity, the web having been placed at the start of said period on the surface of nutrient-salt agar and inoculated with a mixed spore suspension of *Aspergillus niger, Penicillium funiculosum, Chaetomium globosum, Trichoderma sp,* and *Pullularia pullulans,* and comprising the steps of pumping with a fan pump a slurry of said fibrous portion and fibrous portion additives, upon which said binder portion and binder portion additives have been deposited, to a sheet former forming a web, pressing in a press section said web, which is then dried by dryers, compacted on a plurality of steel rolls, and wound on a windup reel, and wherein all components of said fibrous portion and fibrous portion additives except said glass fiber are pulped in a pulper with water, stirred in a drop chest, and macerated in a refiner to form a refined fibrous slurry, the improvement comprising introducing a portion of said refined fibrous slurry into a glass fiber dispersion tank partially filled with water at ambient temperature, transferring the remaining portion of said refined fibrous slurry in said refiner to a latex deposition chest having means for combining said refined fibrous slurry with said binder portion and binder portion additives, the output of said latex deposition chest being transferred to a machine chest for stirring and further transfer to said fan pump, filling said glass fiber dispersion tank with water at ambient temperature, introducing said glass fiber in portions with stirring to said glass fiber dispersion tank to form a glass fiber dispersion, pumping said glass fiber dispersion to a dispersion holding tank, pumping said glass fiber dispersion from said dispersion holding tank to a dispersion feed tank, and pumping said glass fiber dispersion from said dispersion feed tank to said fan pump, where said glass fiber dispersion is mixed with the output of said machine chest.

25. A continuous latex wet-end deposition method of manufacturing as asbestos-free backing web having a thickness from about 0.003 inch to about 0.150 inch, said web having fibrous portion and fibrous portion additives present from about 50% to about 88% of dry weight of backing web and having binder portion and binder portion additives present from about 50% to about 12% of dry weight of backing web, said fibrous portion and fibrous portion additives including cellulosic fiber in an amount from about 40% to about 85%, glass fiber in an amount from about 3% to about 35%, polyolefin fiber having a melting point in the range of about 230° F. to about 380° F. in an amount from about 10% to about 56%, and antifungalantimildew agent in an amount from about 0.5% to about 2.0% all with respect to the dry weight of said fibrous portion and fibrous portion additives, said binder portion and binder portion additives including a synthetic rubber latex or combination of lactices, said web having dimensional stability in the machine direction, the cross machine direction and the diagonal direction such that the web in these directions varies in dimension by not more than about 0.5% when subjected to relative humidity changes in the range of relative humidity of 0% to 100%, or when subject to water soaking with respect to the complete range of relative humidity, said web also exhibiting no visible fungal growth after a 28 day incubation period at 83°-86° F. and not less than 85% relative humidity, the web having been placed at the start of said period on the surface of nutrient-salt agar and inoculated with a mixed spore suspension of *Aspergillus niger, Penicillium funiculosum, Chaetomium globosum, Trichoderma sp,* and *Pullularia pullulans,* wherein a slurry of said fibrous portion and fibrous portion additives is supplied by a fan pump to a sheet former, said binder portion and binder portion additives having been mixed with and uniformly deposited on said fibrous portion and fibrous portion additives at said fan pump, a web is formed by said sheet former, said web is pressed in a press section, dried by dryers, compacted by a calender stack, and wound on a windup reel, and wherein all components of said fibrous portion and fibrous portion additives except said glass fiber are pulped in a pulper with water, stirred in a drop chest, and macerated in a refiner to form a refined fibrous slurry, the improvement comprising introducing a portion of said refined fibrous slurry into a glass fiber dispersion tank partially filled with water at ambient temperature, furnishing the remainder of said refined fibrous slurry to a machine chest for stirring and further transfer to said fan pump, filling said glass fiber dispersion tank with water at ambient temperature, introducing said glass fiber in portions with stirring to said glass fiber dispersion tank to form a glass fiber dispersion, pumping said glass fiber dispersion to a dispersion holding tank, pumping said glass fiber dispersion from said dispersion holding tank to a dispersion feed tank, and pumping said glass fiber dispersion from said dispersion feed tank to said fan pump, where mixing with the output of said machine chest forms said fibrous portion and fibrous portion additives slurry.

26. A continuous latex wet-end deposition method of manufacturing an asbestos-free backing web having a thickness from about 0.003 inch to about 0.150 inch, said web having fibrous portion and fibrous portion additives present from about 50% to about 88% of dry weight of backing web and having binder portion and binder portion additives present from about 50% to about 12% of dry weight of backing web, said fibrous portion and fibrous portion additives including cellulosic fiber in an amount from about 40% to about 85%, glass fiber in an amount from about 3% to about 35%, polyolefin fiber having a melting point in the range of about 230° F. to about 380° F. in an amount from about 10% to about 56%, and antifungalantimildew agent in an amount from about 0.5% to about 2.0% all with respect to the dry weight of said fibrous portion and fibrous portion additives, said binder portion and binder portion additives including a synthetic rubber latex or combination of lactices, said web having dimensional stability in the machine direction, the cross machine direction and the diagonal direction such that the web in these directions varies in dimension by not more than about 0.5% when subjected to relative humidity changes in the range of relative humidity of 0% to 100%, or when subjected to water soaking with respect to the complete range of relative humidity, said web also exhibiting no visible fungal growth after a 28 day incubation period at 83°-86° F. and not less than 85% relative humidity, the web having been placed at the start of said period on the surface of nutrient-salt agar and inoculated with a mixed spore suspension of *Aspergillus niger, Penicillium funiculosum, Chaetomium globosum, Trichoderma sp,* and *Pullularia pullulans,* wherein a slurry of said fibrous portion and fibrous portion additives is supplied by a fan pump to a sheet former having a headbox, said binder portion and binder portion additives are introduced to said fibrous portion and fibrous portion additives slurry at said headbox, and wherein said binder portion and binder portion additives are uniformly deposited on said fibrous portion and fibrous portion additives, and a web is formed by said sheet former, said web is pressed in a press section, dried by dryers, compacted by a calender stack, and wound on a windup reel, and wherein all components of said fibrous portion and fibrous portion additives except said glass fiber are pulped in a pulper with water, stirred in a drop chest, and macerated in a refiner to form a refined fibrous slurry, wherein the improvement comprises introducing a portion of said refined fibrous slurry into a glass fiber dispersion tank partially filled with water at ambient temperature, furnishing the remainder of said refined fibrous slurry to a machine chest for stirring and further transfer to said fan pump, filling said glass fiber dispersion tank with water at ambient temperature, introducing said glass fiber in portions with stirring to said glass fiber dispersion tank to form a glass fiber dispersion, pumping said glass fiber dispersion to a dispersion holding tank, pumping said glass fiber dispersion from said dispersion holding tank to a dispersion feed tank, and pumping said glass fiber dispersion from said dispersion feed tank to said fan pump, where mixing with the output of said machine chest forms said fibrous portion and fibrous portion additives slurry.

27. A continuous latex wet-end deposition method of manufacturing an asbestos-free backing web, said web having fibrous portion and fibrous portion additives present from about 50% to about 88% of dry weight of backing web and having binder portion and binder portion additives present from about 50% to about 12% of dry weight of backing web, said fibrous portion and fibrous portion additives including cellulosic fiber in an amount from about 40% to about 85%, glass fiber in an amount from about 3% to about 35%, polyolefin fiber having a melting point in the range of about 230° F. to about 380° F. in an amount from about 10% to about 56%, and antifungalantimildew agent in an amount from about 0.5% to about 2.0% all with respect to the dry weight of said fibrous portion and fibrous portion additives, said binder portion and binder portion additives including a synthetic rubber latex or combination of latices, said web having dimensional stability in the machine direction, the cross machine direction and the diagonal direction such that the web in these directions varies in dimension by not more than about 0.5% when subjected to relative humidity changes in the range of relative humidity of 0% to 100%, or when subjecting to water soaking with respect to the complete range of relative humidity, said web also exhibiting no visible fungal growth after a 28 day incubation period at 83°-86° F. and not less than 85% relative humidity, the web having been placed at the start of said period on the surface of nutrient-salt agar and inoculated with a mixed spore suspension of *Aspergillus niger, Penicillium funiculosm, Chaetomium globosum, Trichoderma sp,* and *Pullularia pullulans,* wherein a slurry of said fibrous portion and fibrous portion additives is supplied by a fan pump to a sheet former, wherein said sheet former is a cylinder machine having a vat, with a pipe line feeding said fibrous portion and fibrous portion additives slurry from said fan pump to said vat, said binder portion and binder portion additives being introduced to said fibrous portion and fibrous portion additives slurry at said pipe line, and wherein said binder portion and binder portion additives are uniformly deposited on said fibrous portion and fibrous portion additives, and a web is formed by said sheet former, said web is pressed in a press section, dried by dryers, compacted by a calender stack, and wound on a windup reel, and wherein all components of said fibrous portion and fibrous portion additives except said glass fiber are pulped in a pulper with water, stirred in a drop chest, and macerated in a refiner to form a refined fibrous slurry, wherein the improvement comprises introducing a portion of said refined fibrous slurry into a glass fiber dispersion tank partially filled with water at ambient temperature, furnishing the remainder of said refined fibrous slurry to a machine chest for stirring and further transfer to said fan pump, filling said glass fiber dispersion tank with water at ambient temperature, introducing said glass fiber in portions with stirring to said glass fiber dispersion tank to form a glass fiber dispersion, pumping said glass fiber dispersion to a dispersion holding tank, pumping said glass fiber dispersion from said dispersion holding tank to a dispersion feed tank, and pumping said glass fiber dispersion from said dispersion feed tank to said fan pump, where mixing with the output of said machine chest forms said fibrous portion and fibrous portion additives slurry.

* * * * *